US007384189B2

(12) United States Patent
Wyssbrod

(10) Patent No.: US 7,384,189 B2
(45) Date of Patent: Jun. 10, 2008

(54) WATCH INCLUDING MEANS FOR IMPROVING THE SHOCK RESISTANCE OF THE CRYSTAL

(75) Inventor: Baptist Wyssbrod, Nidau (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 63 days.

(21) Appl. No.: 11/382,596

(22) Filed: May 10, 2006

(65) Prior Publication Data

US 2006/0256667 A1 Nov. 16, 2006

(30) Foreign Application Priority Data

May 11, 2005 (EP) ..... 05103932

(51) Int. Cl.
*G04C 21/12* (2006.01)

(52) U.S. Cl. ..... 368/294; 368/295; 368/296

(58) Field of Classification Search ..... 368/294–296
See application file for complete search history.

(56) References Cited

U.S. PATENT DOCUMENTS 3,688,492 A 9/1972 Yabana
4,257,118 A 3/1981 Futaba et al.
6,813,223 B1 * 11/2004 Born et al. ..... 368/255

FOREIGN PATENT DOCUMENTS

| | | |
|---|---|---|
| CH | 3368/66 | 10/1967 |
| CH | 14232/65 | 10/1967 |
| EP | 1 089 143 A1 | 4/2001 |
| FR | 1.486.064 | 6/1967 |

* cited by examiner

*Primary Examiner*—Gary F. Paumen
(74) *Attorney, Agent, or Firm*—Griffin & Szipl, P.C.

(57) ABSTRACT

The invention proposes a watch comprising a case which includes a middle part, a crystal and a display dial. The crystal includes an outer radial collar which abuts axially against the middle part and which is held axially against the middle part by means of a bezel. The bezel includes a lower annular radial surface which abuts axially against the top face of the collar. According to one feature of the invention, the collar includes a convex outer peripheral surface which is generally complementary to a concave inner surface of the bezel arranged opposite, underneath the radial abutment surface of the bezel and which abuts radially against said inner surface in the event of an axial shock applied to the crystal.

10 Claims, 2 Drawing Sheets

WATCH INCLUDING MEANS FOR IMPROVING THE SHOCK RESISTANCE OF THE CRYSTAL

This application claims priority from European Patent Application No. 05103932.9 filed May 11, 2005, the entire disclosure of which is incorporated herein by reference.

FIELD OF THE INVENTION

The invention concerns a watch including a case fitted with a middle part and a crystal secured to the middle part by means of a peripheral bezel.

The invention concerns more particularly a watch including a case that comprises a middle part, a crystal, and a display dial, of the type in which the crystal includes an external radial collar which abuts axially against the middle part and which is held axially against the middle part by means of a peripheral bezel secured to the middle part, the bezel including a lower annular radial surface which abuts axially against the top face of the collar.

BACKGROUND OF THE INVENTION

Watches wherein the crystal is secured to the middle part by means of a bezel are already known. For example, U.S. Pat. No. 3,688,492 discloses and shows a watch including a flat crystal which is secured to the middle part by driving a bezel into a groove formed in the top face of the middle part. The bezel includes an inner shoulder which abuts axially against the top radial face of a radial collar of the crystal to hold it pressed against the middle part.

With this type of watch, when an axial shock is applied to the crystal, for example, when it falls from the height of a table, stresses are mainly applied axially because of the flat external face of the crystal. Stresses can thus be taken up axially by the middle part at the surface of the crystal that axially abuts the middle part. Thus, the crystal works mainly in axial compression, and it does not undergo any bending.

This is not the case when the watch is provided with a crystal of convex hemispheric shape. Indeed, the axial shock is then applied on the central part of the crystal, which causes a significant deformation of the crystal, which tends to bend and collapse in its central part, while the collar of the crystal tends to move outwards.

These deformations of the crystal can cause cracks, or even breaks. Such cracks can be due in particular to the central part of the crystal coming into contact with the to end of the arbour of the display hands of the watch or to internal stresses in the material forming the crystal.

In the aforecited document, if axial stress localised in the central part of the crystal caused an outward radial movement of the collar, the crystal would then abut against the top end section of the bezel, which would apply torsional stress that is detrimental to its mechanical resistance. Moreover, since the bezel is driven in towards the inside of the case via its internal edge, the torsional stress would be applied in the direction that the bezel is disassembled, with a significant risk of disassembling the crystal.

It is an object of the invention to eliminate these drawbacks in a simple and economical manner.

For the purpose, the invention proposes a watch of the type previously described, characterized in that the collar includes a convex external peripheral surface which is generally complementary to a concave inner surface of the bezel arranged opposite, underneath the radial abutting surface of the bezel, and which abuts against said inner surface radially if an axial shock is applied to the crystal.

Owing to the arrangement according to the invention, in the event of an axial shock, the flexion stresses are decreased which decreases the risk of cracks. The crystal of the watch according to the invention thus has improved shock resistance.

Moreover, it is generally necessary to provide pre-centring means on the crystal collar in order to position the crystal properly with respect to the middle part, prior to assembling the bezel; otherwise there is a risk of the crystal being damaged by the bezel, or it being impossible to assemble the bezel. These pre-centring means can be the cause of premature breakage of the crystal, because of the significant deformation caused by an axial shock.

In order to overcome this problem, according to an advantageous feature of the invention, on the side of the inner peripheral edge of the collar, the bottom radial face of the collar includes at least one positioning lug which extends downwards, between the dial and the inner axial wall of the middle part, and the radial distance between the lug and the inner axial wall of the middle part is greater than the radial distance between the outer surface of the collar and the inner surface of the bezel, such that, in the event of an axial shock, the outer surface of the collar abuts radially against the inner surface of the bezel before the lug comes into contact with the inner axial wall of the middle part.

According to another feature of the invention, the outer surface of the collar and the inner surface of the bezel have complementary frustro-conical forms.

These forms enable optimum shock resistance to be obtained.

According to another feature of the invention, the middle part includes an outer peripheral edge comprising a substantially frustro-conical concave inner wall having a downwardly increasing diameter, the bezel includes an annular heel portion, which is driven axially, from the top downwards, into the middle part, such that the outer peripheral wall of the heel portion is pressed radially against the inner wall of the edge, and in that the inner surface of the bezel is formed by the inner wall of the heel portion.

This feature enables the middle part to bear the stresses applied by the crystal to the inner surface of the bezel.

According to another feature of the invention, the outer wall of the heel portion has a frustro-conical shape which defines an angle smaller than the angle defined by the inner surface of the bezel.

This feature means that the bezel can be driven into the middle part without any risk of overloading the crystal.

BRIEF DESCRIPTION OF THE DRAWINGS

Other features and advantages of the present invention will appear more clearly upon reading the following detailed description, made with reference to the annexed drawings, given by way of non limiting example and in which.

DETAILED DESCRIPTION OF THE ILLUSTRATIVE EMBODIMENTS

Figure 1:
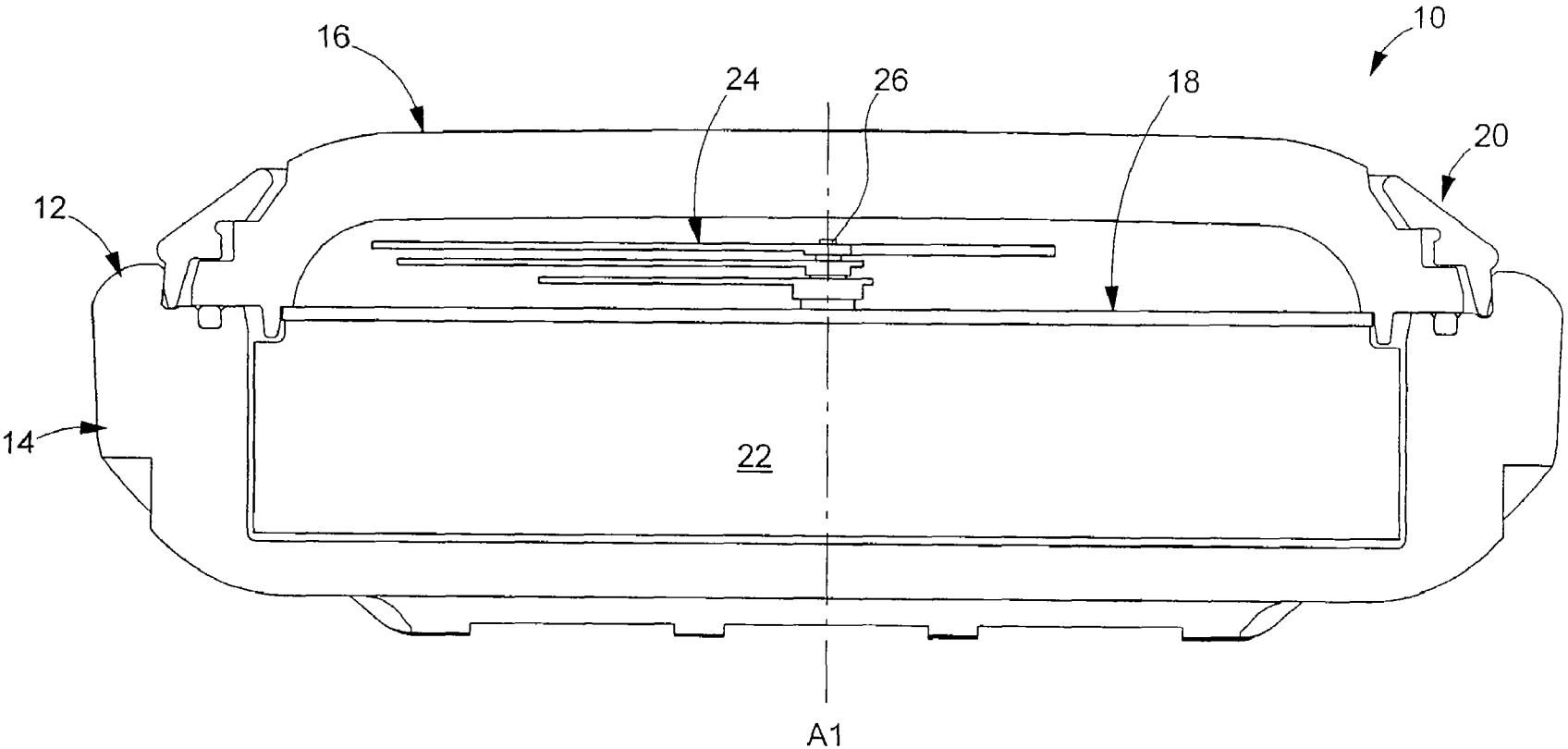
FIG. 1 is an axial cross-section which shows schematically a watch according to the teaching of the invention.

FIG. 1 shows a watch 10, which is made in accordance with the teaching of the invention.

Watch 10 includes a case 12 which includes a middle part 14, a crystal 16, and a display dial 18. Case 12 is also fitted with a peripheral bezel 20 which is snap fitted in middle part 14 so as to hold crystal 16 axially against middle part 14.

The outer surface of crystal 16 has here an overall convex hemispheric shape.

Case 12, which is overall cylindrical here, contains a watch movement 22 which is arranged underneath dial 18 and which controls the analogue display means 24 formed here by hands 24 rotatably mounted about a central vertical axis A1.

In the following description, a vertical orientation along axis A1 of hands 24, which corresponds here to the axis of case 12, will be used in a non-limiting manner.

According to the embodiment shown here, a central projecting part 26 of analogue display means 24 is formed by the end 26 of the second wheel arbour, which carries the second hand.

Of course, according to alternative embodiments (not shown), the projecting part 26 can be formed by another element, such as a fixed central lug, or the central part of a hand.

Figure 3:
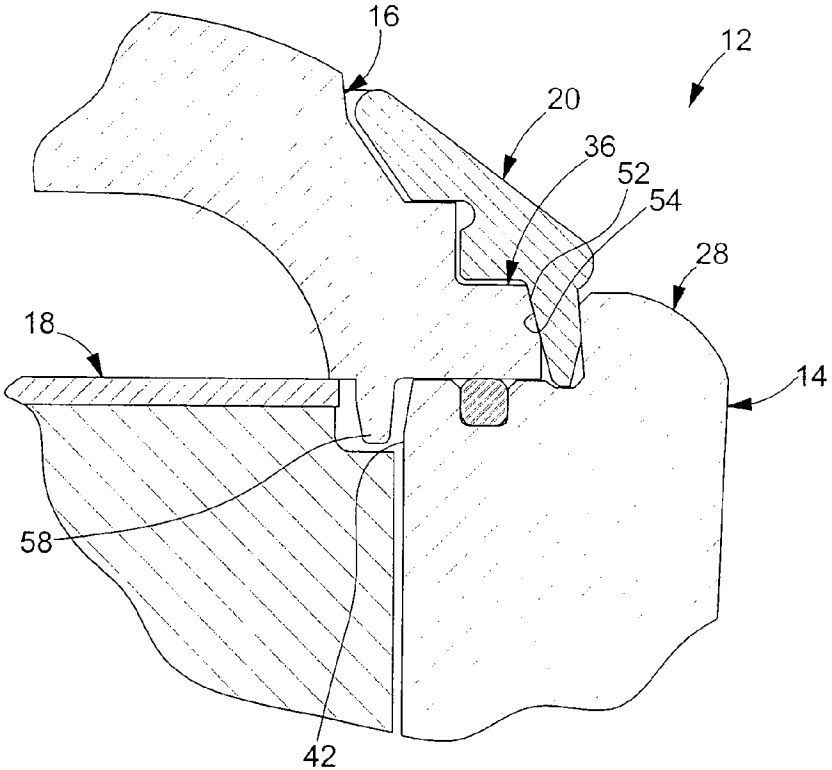
FIG. 3 is a similar view to that of FIG. 2 which shows the peripheral portion of the watch during an axial shock.
Figure 2:
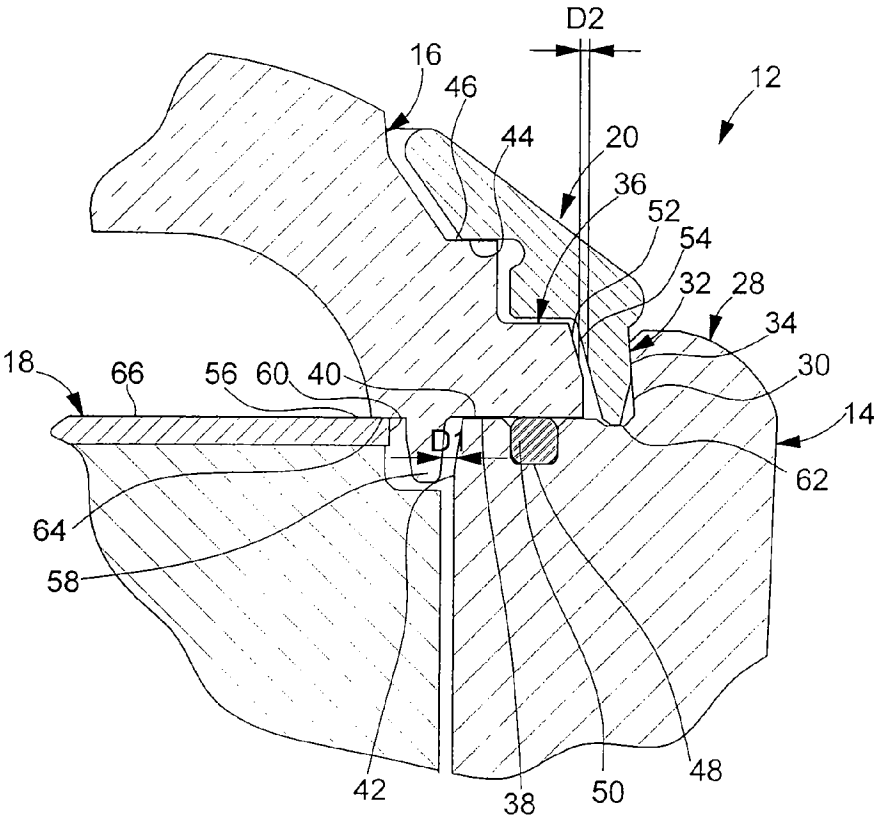
FIG. 2 is an enlarged view of one detail of FIG. 1 showing schematically a peripheral portion of the watch at rest.

As shown, in particular in FIGS. 2 and 3, middle part 14 includes an outer peripheral edge 28, which defines a concave substantially frustro-conical inner wall 30 having a downwardly increasing diameter.

Bezel 20 includes a lower annular heel portion 32 which is driven axially, from the top downwards, into middle part 14 such that the outer peripheral wall 34 of lug 32 is pressed radially against inner wall 30 of edge 28.

Crystal 16 includes an outer radial collar 36 which abuts axially, via its lower radial face 38, against an annular radial bearing surface 40 of middle part 14. This radial bearing surface 40 is delimited towards the interior by inner axial wall 42 of middle part 14.

Bezel 20 includes a lower annular radial surface 44, which abuts axially against top face 46 of collar 36, which enables collar 36 to be tightened against between radial surface 44 of bezel 20 and radial bearing surface 40 of middle part 14 in order to hold crystal 16 axially against middle part 14.

Radial abutment surface 44 is arranged in one section of bezel 20 located above heel portion 32.

Preferably, radial bearing surface 40 is substantially aligned axially with radial abutment surface 44 of bezel 20.

According to the embodiment shown here, middle part 14 includes an annular groove 48 which is inserted radially between radial bearing surface 40 and outer peripheral edge 28, and which receives an annular "O-ring" type sealing gasket 50. Sealing gasket 50 is compressed between middle part 14 and the lower radial face 38 of collar 36.

In accordance with the teaching of the invention, collar 36 includes a convex outer peripheral surface 52, which is generally complementary to a concave inner surface 54 of bezel 20 arranged opposite, underneath the lower radial abutment surface 44 of bezel 20, and which abuts radially against said inner surface 54 in the event of an axial shock applied to crystal 16.

At rest, as shown in FIG. 2, a radial play D2 is arranged between outer surface 52 of collar 36 and inner surface 54 of bezel 20.

According to another embodiment, this radial play D2 can be zero, which is the case of the axial shock shown in FIG. 3.

Advantageously, lower radial face 38 of collar 36 includes, on the side of inner peripheral edge 56 of collar 36, at least one positioning lug 58 which extends downwards. Moreover, the radial distance D1 between lug 58 and inner axial wall 42 of middle part 14 is greater than the radial distance D2 between outer surface 52 of collar 36 and inner surface 54 of bezel 20.

Preferably, crystal 16 includes several lugs 58 which are distributed angularly in a regular manner. These lugs 58 each have the overall shape of a frustro-conical pin and they are provided to cooperate by sliding with the adjacent edge of middle part 14 and/or the outer peripheral edge 60 of dial 18 so as to pre-centre crystal 16 in relation to middle part 14 when crystal 16 is mounted on case 12, prior to the assembly of bezel 20.

It should be noted that lugs 58 can also angularly index crystal 16 in relation to dial 18, when they are associated with notches arranged in outer peripheral edge 60 of dial 18.

Also preferably, outer surface 52 of collar 36 and inner surface 54 of bezel 20 have complementary frustro-conical shapes for better distribution of mechanical stresses in the event of an axial shock on crystal 16. The diameter of these frustro-conical surfaces increases downwardly.

The inner surface 54 of bezel 20 is formed by the inner wall of heel portion 32.

Advantageously, outer wall 34 of heel portion 32 has a frustro-conical shape which defines, in relation to axis A1, a smaller angle than the angle defined by its inner surface 54 of heel portion 32. This feature avoids stressing crystal 16 when bezel 20 is driven into middle part 14.

Middle part 14 includes here an annular radial surface 62 which is inserted between the annular groove 48 and the inner wall 30 of edge 28. Once bezel 20 has been driven into middle part 14, heel portion 32 is provided to abut axially against this radial surface 62 via its free lower end, which also avoids overloading crystal 16 once the driving in operation is complete.

According to the embodiment shown here, lugs 58 are slightly offset radially outwards, in relation to inner peripheral edge 56 of collar 36, which delimits, in lower radial face 38 of collar 36, an annular inner portion 64 which abuts axially against the top surface 66 of dial 18.

We will now explain the behaviour of watch 10 when an axial shock is applied to crystal 16.

In FIGS. 1 and 2, watch 10 is in the rest state and crystal 16 is not deformed.

In FIG. 3, an axial shock is applied from the top downwards onto crystal 16.

The central part of crystal 16 is deformed downwardly and tends to move closer to projecting central part 26. This deformation causes collar 36 to slide radially outwards, until its outer surface 52 abuts radially against inner surface 54 of bezel 20.

At this stage, the mechanical stresses due to the shock are distributed in the material of crystal 16 as a function of the abutment zones.

Advantageously, the inner stresses in crystal 16 are minimised as they are taken up by bezel 20, at the radial abutment of crystal 16 against bezel 20, which rigidifies the abutment of crystal 16 onto middle part 14 to limit the bending of crystal 16 in the central portion thereof.

Owing to the arrangement according to the invention, the radial slide of collar 36 stops before lugs 58 come into contact with middle part 14, which reduces the risk of crystal

16 breaking. Moreover, stopping the radial slide of collar 36 limits the axial movement of the central part of crystal 16 towards projecting central part 26, which also reduces the risk of crystal 16 breaking.

What is claimed is:

1. A watch including a case which includes a middle part, a crystal, a bezel which is snap fitted in the middle part-and a display dial, of the type wherein the crystal includes an outer radial collar which abuts axially against an annular radial bearing surface of the middle part and which is held axially against the middle part by means of a lower annular radial abutment surface of the bezel which abuts axially against the top face of the collar and an annular heel portion which is driven axially, from the top downwards, into the middle part such that the outer peripheral wall of the heel portion is pressed radially against the inner wall of an outer peripheral edge of the middle part, wherein said radial abutment surface is arranged in one section of bezel located above the heel portion and is substantially aligned axially with the annular radial bearing surface of the middle part, wherein the collar includes a convex outer peripheral surface which is generally complementary to a concave inner surface of the bezel arranged opposite, underneath the radial abutment surface of the bezel and which abuts radially against said inner surface in the event of an axial shock applied to the crystal, and wherein the inner surface of the bezel is formed by the inner wall of the heel portion.

2. The watch according to claim 1, wherein the lower radial face of the collar includes, on the side of the inner peripheral edge of the collar, at least one positioning lug which extends downwardly, between the dial and the inner axial wall of the middle part, and wherein the radial distance between the lug and the inner axial wall of the middle part is greater than the radial distance between the outer surface of the collar and the inner surface of the bezel such that, in the event of an axial shock, the outer surface of the collar abuts radially against the inner surface of the bezel before the lug comes into contact with the inner axial wall of the middle part.

3. The watch according to claim 1, wherein the outer surface of the collar and the inner surface of the bezel have complementary frustro-conical shapes.

4. The watch according to claim 1, wherein the inner wall of the outer peripheral edge of the middle part is concave and substantially frustro-conical having a downwardly increasing diameter.

5. The watch according to claim 1, wherein the outer surface of the collar and the inner surface of the bezel have complementary fi-ustro-conical shapes, wherein the inner wall of the outer peripheral edge of the middle part is concave and substantially frustro-conical having a downwardly increasing diameter, and wherein the outer wall of the heel portion has a frustro-conical shape which defines a smaller angle than the angle defined by the inner surface of the bezel.

6. The watch according to claim 4, wherein the free lower end of the heel portion abuts axially against an associated bearing surface arranged in the middle part.

7. The watch according to claim 1, wherein the middle part includes an annular radial bearing surface which is substantially axially aligned with the radial abutment surface of the bezel, such that the collar is held gripped axially between said two surfaces, and wherein the radial bearing surface is delimited inwardly by the inner axial wall of the middle part.

8. The watch according to claim 7, wherein the middle part includes an annular groove which is inserted between the radial bearing surface and the outer peripheral edge, and which receives a sealing gasket compressed between the middle part and the collar.

9. The watch according to claim 1, wherein the outer surface of the crystal has an overall convex hemispheric shape.

10. The watch according to claim 1, wherein the case contains a watch movement fitted with analogue display means.

* * * * *